US007541726B2

(12) United States Patent
Li et al.

(10) Patent No.: US 7,541,726 B2
(45) Date of Patent: Jun. 2, 2009

(54) LAMP FILAMENT

(75) Inventors: Jason J. Li, Boxford, MA (US); Alexander N. Kasak, Marcellus, NY (US); Heinz W. Sell, Cushing, ME (US); Alan L. Lenef, Belmont, MA (US); Raymond T. Fleming, Lexington, KY (US); Richard C. Laird, El Paso, TX (US)

(73) Assignee: Osram Sylvania Inc., Danvers, MA (US)

( * ) Notice: Subject to any disclaimer, the term of this patent is extended or adjusted under 35 U.S.C. 154(b) by 458 days.

(21) Appl. No.: 11/436,001

(22) Filed: May 17, 2006

(65) Prior Publication Data

US 2008/0018219 A1 Jan. 24, 2008

(51) Int. Cl.
*H01K 1/14* (2006.01)

(52) U.S. Cl. ..... 313/315

(58) Field of Classification Search ..... 313/9, 313/315, 316, 224, 344, 578
See application file for complete search history.

(56) References Cited

U.S. PATENT DOCUMENTS

| | | | | |
|---|---|---|---|---|
| 2,012,825 | A | 8/1935 | Millner et al. | 75/17 |
| 3,665,240 | A * | 5/1972 | Archer | 313/344 |
| 3,736,458 | A * | 5/1973 | Miller et al. | 313/344 |
| 3,942,063 | A * | 3/1976 | Winter et al. | 313/315 |
| 4,686,412 | A * | 8/1987 | Johnson, Jr. | 313/344 |
| 6,600,255 | B1 | 7/2003 | Kai et al. | 313/271 |
| 6,690,103 | B1 * | 2/2004 | Uke | 313/344 |
| 6,781,291 | B2 * | 8/2004 | Halpin | 313/279 |
| 2004/0070324 | A1 * | 4/2004 | Lisitsyn | 313/271 |

OTHER PUBLICATIONS

Brett et al, Filaments for Incandescent Lamps with Energy Conserving Envelopes , Mar. 1981, IEEE Transactions on Industry Applications, vol. IA-17, Issue 2, pp. 210-216.*

* cited by examiner

*Primary Examiner*—Scott B. Geyer
*Assistant Examiner*—Andrew J Coughlin
(74) *Attorney, Agent, or Firm*—Carlo S. Bessone

(57) ABSTRACT

A base-up incandescent lamp (10) includes a coiled-coil filament (14) that has a primary wire (18) and a secondary wire (16), the primary wire (18) comprising an overwind that overlies the secondary wire (16) and provides a lower filament temperature and, therefore, less filament sag and a concomitant longer lamp life.

5 Claims, 4 Drawing Sheets

LAMP FILAMENT

TECHNICAL FIELD

This invention relates to lamp filaments and particularly to such filaments having a lower temperature and longer life than conventional coil designs. It is particularly useful with infrared (IR) lamps.

BACKGROUND ART

In typical incandescent lamps a tungsten coil of a given length and wire diameter is used to radiate both visible light and IR radiation when an electrical current is passed through it.

The tungsten coil will sag over time, especially when the operating temperature exceeds 3000 C, as is known to happen in some demanding applications. It is known that the addition of potassium will reduce, but not eliminate, the coil sagging, as is shown from U.S. Pat. No. 2,012,825.

In the case of lamps used in a vertical, base-up position, that is, with the axis of the coil perpendicular to the ground, the sag will eventually cause a short circuit in the filament, which will lead to higher currents passing through the coil with a concomitant increase in coil temperature. The increase in temperature accelerates the coil sagging and causes a further compression of the turns of the coil. It has been suggested in U.S. Pat. No. 6,600,255 that this problem can somewhat be alleviated by using a coil having two distinct pitches with a wider pitch at the bottom of the coil.

DISCLOSURE OF INVENTION

It is, therefore, an object of the invention to obviate the disadvantages of the prior art.

It is another object of the invention to enhance the operation of tungsten filaments.

Still another object of the invention is an increase in the effective radiative surface area of the coil.

These objects are accomplished, in one aspect of the invention by the provision of a base-up incandescent lamp including a coiled-coil filament, said coiled-coil filament comprising a primary wire and a secondary wire, said primary wire comprising an overwind that overlies said secondary wire.

The overwind increases the effective radiative surface area of the coil and also produces a blackbody cavity effect that increases the effective emissivity of the secondary wire. These effects enhance the visible and IR radiated power per unit length and, therefore, lowers the filament temperature when operating at a fixed power. Operating at a lower temperature reduces the sag rate and thus increases lamp life. Alternatively, a lamp according to this aspect of the invention can be operated at higher powers to produce more IR radiation at the same color temperature.

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Figure 1:
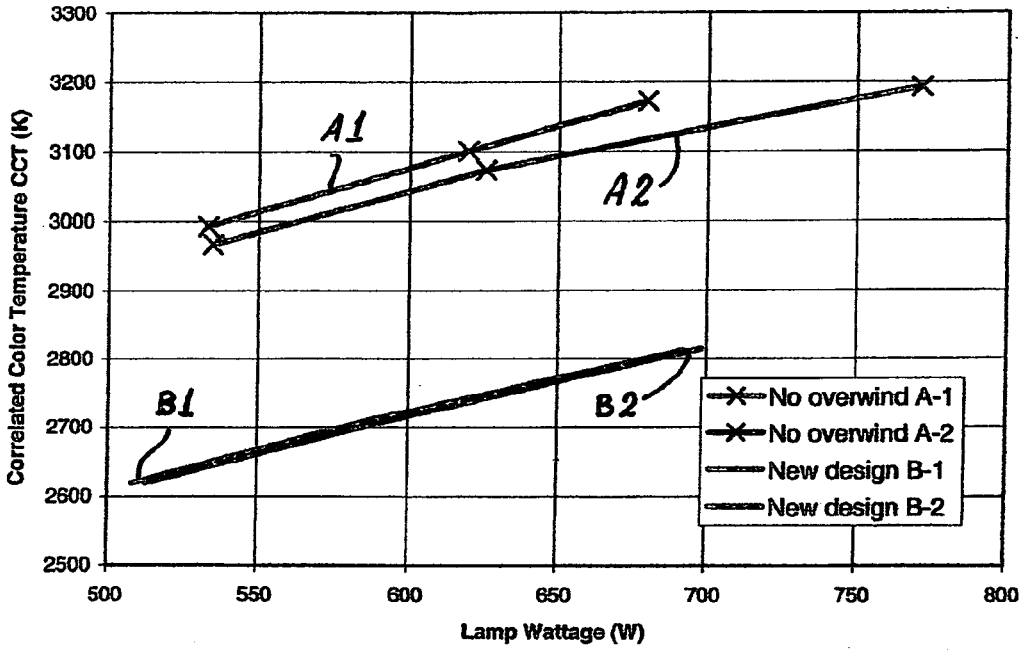
FIG. 1 is a graph of color temperature versus lamp wattage for two prior art lamps and two lamps embodying an aspect of the invention.

Referring now to the drawings with greater particularity, there is shown in FIG. 1 a graph illustrating a comparison between lamps of the prior art and lamps employing the overwind of the invention. From FIG. 1 it can clearly be seen that lamps employing the overwind (lamps B1 and B2) have a lower temperature when operated at the same power then the prior art lamps (A1 and A2). Since the coil sag rate is lower at the reduced temperatures, the life is extended.

Figure 2:
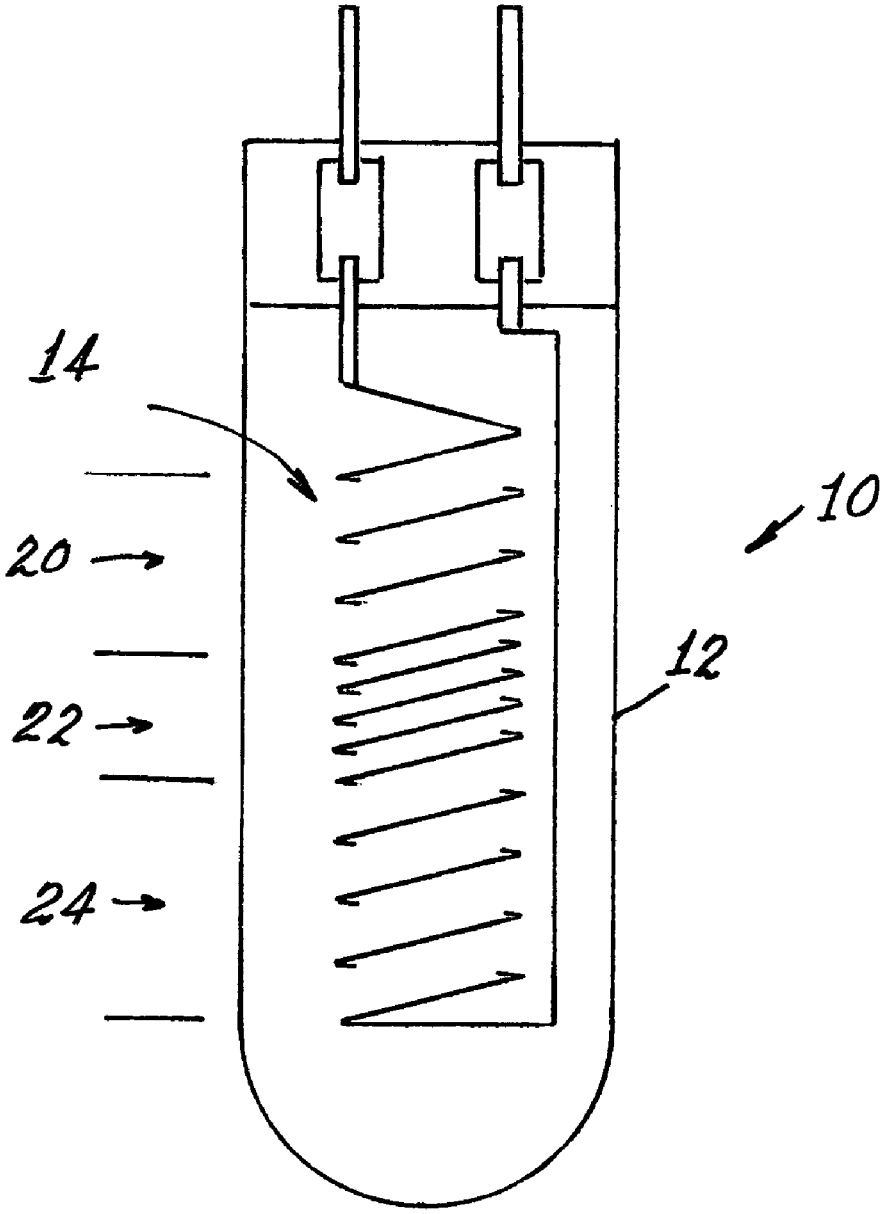
FIG. 2 is a diagrammatic elevational view of a lamp with a filament in accordance with an aspect of the invention.
Figure 3:
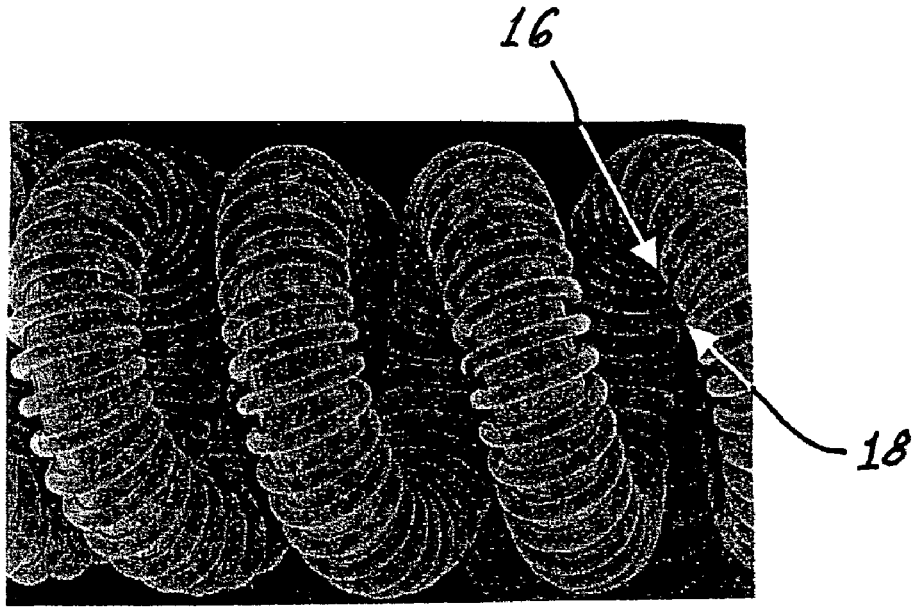
FIG. 3 is an enlarged view of a filament in accordance with an aspect of the invention.

Additionally, the life of the filament can be further increased by varying the pitch between the coils, as is shown diagrammatically in FIG. 2. Therein, a lamp 10, designed for base-up operation, has an envelope 12 enclosing a coiled coil filament 14. The coiled coil filament 14 has a secondary wire 16 and a primary overwind wire 18, shown in FIG. 3. The coiled coil filament 14 is provided with at least two sections with varying pitch therebetween and as illustrated in FIG. 2 the coiled coil 14 filament is provided with three such sections, 20, 22, and 24.

As used herein the "pitch" is defined as the distance between two turns of wire (wire center to wire center) divided by the diameter of the wire, expressed as a percentage. Thus, a pitch of 100% indicates that adjacent turns are touching and a pitch of 200% indicates that the turns are spaced apart a distance equal to the diameter of the wire.

In a preferred embodiment of the invention, the filament can have a first section 20 pitch of 158%, a second section 22 pitch of 133%, and a third section pitch of 158%.

The overwind pitch can vary between a pitch of about 170% to 254% with 170% being preferred and the overwind wire diameter can be between 1 and 2 mils, with 2 mils being preferred. The secondary wire diameter can be between 9.19 mils and 10.27 mils; however the preferred secondary wire has a diameter of 9.55 mils and a length of 790 mm.

Table 1 below illustrates the various parameters, which are plotted in FIG. 4, which clearly shows the effects of the overwind.

TABLE I

| Lamp Designation | Secondary Wire Length (mm) | Secondary Wire Diameter (Mils) | Overwind Wire Diameter (Mils) | Overwind Wire Pitch (%) |
|---|---|---|---|---|
| 5513 | 793.5 | 10.27 | None | None |
| 5580 | 726 | 9.19 | 1.0 | 253 |
| H2947 | 723.9 | 9.19 | 2.0 | 254 |

TABLE I-continued

| Lamp Designation | Secondary Wire Length (mm) | Secondary Wire Diameter (Mils) | Overwind Wire Diameter (Mils) | Overwind Wire Pitch (%) |
|---|---|---|---|---|
| H2946 | 723.9 | 9.19 | 2.0 | 170 |
| H2949 | 790 | 9.55 | 2.0 | 254 |
| H2948 | 790 | 9.55 | 2.0 | 170 |

Figure 4:
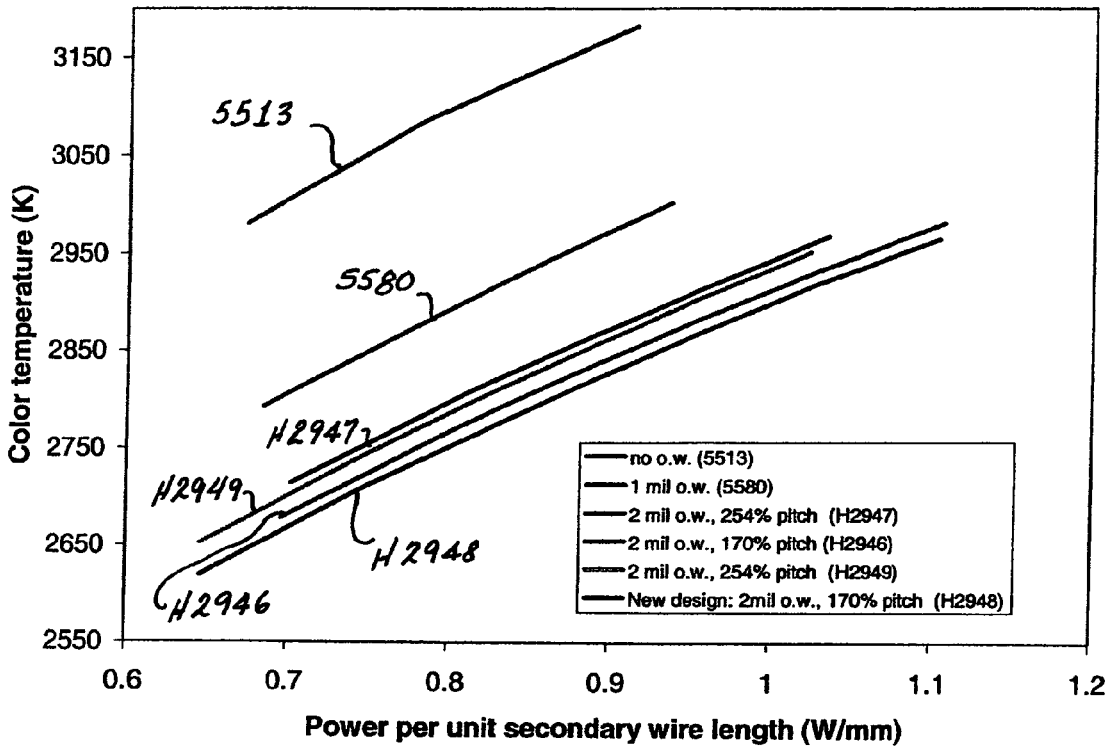
FIG. 4 is a graph of color temperature versus power per unit length of the secondary wire, expressed in watts per millimeter.

The color temperature and power per unit length data in FIG. 4 are an average of two lamps for each lamp group. The main result of the data is the strong influence of the primary overwind on color temperature (and therefore filament temperature) for a given electrical power input per unit length of secondary wire. This is clearly seen in the 200 K drop on color temperature when going from no overwind to a 1 mil overwind with a 253% pitch. Another 125-150 K drop occurs when going from the 1 mil overwind to a 2 mil overwind at a pitch of 170%. Thus, using an overwind layer increases the life of the filament by reducing the color temperature without reducing the IR irradiance, More particularly, the data also illustrate how to optimize the overwind layer design. Clearly, going from the 1 mil overwind (item 5580) to the 2 mil overwind (items H2947 and H2949) at the 254% pitch increase radiated power at a given filament temperature because of the larger emitting surface area of the overwind layer. Equivalently, one can reduce the operating temperature at a given input power. Decreasing the pitch to 170% (items H2946 and H2948) further lowers the color temperature compared to the equivalent lamps with the 254% pitch.

Table II below shows the measurements of actual total radiated visible and IR power from the lamps shown in Table I.

TABLE II

| Lamp Designation | Measured Electrical Power (W) | Measured Radiated Power (W) 90.4-4.5 um) | Measured Radiative Efficiency | Relative Radiated Power per Unit Length (measured) | Relative Radiated Power per Unit Length (Theoretical) |
|---|---|---|---|---|---|
| 5513 | | | | | 60.2% |
| 5580 | 636 | 503 | 79.1% | 76.8% | 84.1% |
| H2947 | 737 | 606 | 82.2 | 92.8 | 92.3 |
| H2946 | 758 | 625 | 82.5% | 95.7% | 96.9% |
| H2949 | 809 | 666 | 82.3% | 93.4% | 95.3% |
| H2948 | 854 | 713 | 83.5% | 100.0% | 100.0% |

The measurements were performed by first making absolute spectral irradiance measurements over the entire wavelength range. These measurements were then converted to absolute fluxes through comparisons of visible wavelength absolute flux measurements made in an integrating sphere.

The results show that at a fixed color temperature of 2950K, all four lamps with the 2 mil overwind produced considerably more total radiated power than the lamp with the 1 mil overwind. This shows that the increased electrical power at a fixed color temperature with the larger overwind is going directly into desired radiated power. The corresponding efficiencies of visible and IR radiated power to electrical power are also displayed.

While there have been shown and described what are present considered to be the preferred embodiments of the invention, it will be apparent to those skilled in the art that various changes and modifications can be made herein without departing from the scope of the invention as defined by the appended claims.

What is claimed is:

1. A base-up incandescent lamp including a coiled-coil filament, said coiled-coil filament comprising a primary wire and a secondary wire, said primary wire comprising an overwind that overlies said secondary wire, wherein said overwind has a pitch of about 170%.

2. A base-up incandescent lamp including a coiled-coil filament, said coiled-coil filament being formed of a secondary wire having:

a first section having a first pitch;

a second section having a second pitch different from said first pitch;

a third section having a pitch different from said second section; and a primary wire overwind overlying said secondary wire;

wherein said first section has a pitch of about 158%; said second section has a pitch of about 133%; and said third section has a pitch of about 158%.

3. The base-up lamp of claim 2 wherein said overwind has a pitch of about 170%.

4. The base-up lamp of claim 3 wherein said primary wire and said secondary wire are tungsten.

5. The base-up lamp of claim 4 wherein said secondary wire has a diameter of about 9.55 mils to about 10.27 mils and said primary wire has a diameter of about 1 to 2 mils.

* * * * *